US005403411A

United States Patent [19]

Smith et al.

[11] Patent Number: 5,403,411

[45] Date of Patent: Apr. 4, 1995

[54] METHOD FOR INCREASING THE FRACTURE RESISTANCE OF TITANIUM COMPOSITES

[75] Inventors: Paul R. Smith, Springboro; Daniel Eylon, Dayton, both of Ohio

[73] Assignee: The United States of America as represented by the Secretary of the Air Force, Washington, D.C.

[21] Appl. No.: 867,724

[22] Filed: Mar. 23, 1992

[51] Int. Cl.[6] ..... C22C 14/00

[52] U.S. Cl. ..... 148/514; 148/669; 148/670; 428/660

[58] Field of Search ..... 148/514, 669, 670; 428/614, 660

[56] References Cited

U.S. PATENT DOCUMENTS

| | | | |
|---|---|---|---|
| 3,991,928 | 11/1976 | Friedrich | 228/190 |
| 4,098,623 | 7/1978 | Ibaraki et al. | 148/133 |
| 4,675,964 | 6/1987 | Allison | 148/670 |
| 4,733,816 | 3/1988 | Eylon et al. | 228/190 |
| 4,807,798 | 2/1989 | Eylon et al. | 228/190 |
| 4,816,347 | 3/1989 | Rosenthal et al. | 428/615 |
| 4,822,432 | 4/1989 | Eylon et al. | 148/127 |
| 4,975,125 | 12/1990 | Chakrabarti et al. | 148/669 |
| 5,125,986 | 6/1992 | Kimura et al. | 148/670 |

*Primary Examiner*—Upendra Roy

*Attorney, Agent, or Firm*—Charles E. Bricker; Thomas L. Kundert

[57] ABSTRACT

The fracture resistance of titanium alloy matrix composites is increased by one of two methods. One method comprises the steps of consolidating a titanium alloy-fiber preform under suitable conditions to provide a metal matrix composite and thermally treating the thus-prepared composite at a temperature above the beta-transus temperature of the alloy for a brief time. In the second method, a composite having increased fracture resistance is produced by consolidating an alloy-fiber preform at a temperature above the normal consolidation temperature for a time less than the normal consolidation time.

8 Claims, 1 Drawing Sheet

METHOD FOR INCREASING THE FRACTURE RESISTANCE OF TITANIUM COMPOSITES

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy/fiber composite materials. In particular, this invention relates to a method for improving the fracture resistance of such composite materials.

Composites are recognized as a material class capable of operating under conditions requiring very high specific stiffness and strength. Synthetic matrix composites are generally limited to maximum operating temperatures of about 200° C. Metal matrix composites are capable of higher operating temperatures. Aluminum- and titanium-based composites comprise the majority of metal matrix composites employed, particularly in aerospace applications. Aluminum-based composites are currently limited in application to about 800° F., due to their degraded matrix strength at higher temperatures. Titanium-based composites are currently considered for many advanced aerospace applications in the temperature range of 800°–1800° F. due to improved matrix creep and environmental resistance.

Continuously reinforced conventional titanium matrices, e.g., Ti-6Al-4V and Ti-15V-3Al-3Cr-3Sn, have been the subject of numerous investigations. Metal matrix composites of these alloys have found limited applications in the temperature range of 800°–1200° F. Significant applications are under consideration for composites utilizing the ordered intermetallic matrices based in the $Ti_3Al$ compound. This class of materials has greatly improved environmental resistance as well as high temperature strength retention and is being considered for applications up to 1800° F. In both classes of titanium composites, the fatigue properties in the direction of the reinforcement are reasonably good and represent improvements over the unreinforced materials. However, off-axis fracture properties are significantly reduced when compared to the monolithic (non-reinforced) alloys due to the poor load transfer at the interface, thereby limiting their application where isotropic properties are required. The composite fatigue properties have been shown to be controlled by matrix failure relatively early in life. It is assumed that these complex systems contain small defects in their as-fabricated condition. Such defects include reaction zone microcracks, reaction zone and matrix voids, matrix disbonds and cracked fibers. The fatigue life of the composite is then dictated by the time/load necessary to cause these flaws to propagate to a critical size wherein the composite fails. If the time/load required to reach this critical size is increased, the service life of the composite is similarly increased, particularly in applications requiring off-axis orientation loading.

Accordingly, it is an object of this invention to provide a method for increasing the fracture resistance of titanium alloy matrix composites.

Other objects and advantages of the invention will be apparent to those skilled in the art.

SUMMARY OF THE INVENTION

In accordance with the present invention, there is provided a method for increasing the fracture resistance of titanium alloy matrix composites. One embodiment of this invention comprises the steps of consolidating a titanium alloy-fiber preform under suitable conditions to provide a metal matrix composite and thermally treating the thus-prepared composite.

In another embodiment of the invention, a composite having increased fracture resistance is produced by consolidating an alloy-fiber preform at a temperature above the normal consolidation temperature for a time less than the normal consolidation time.

DETAILED DESCRIPTION OF THE INVENTION

Figure 1:
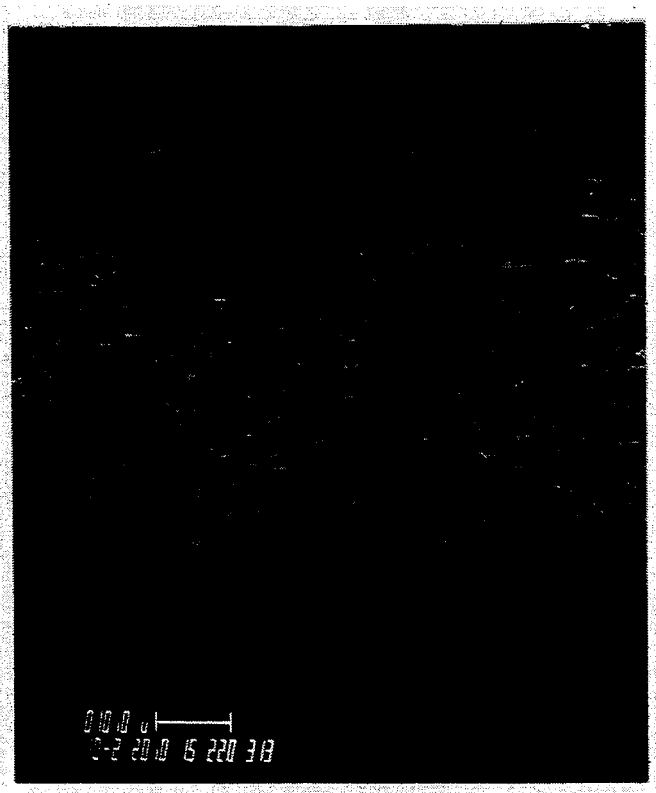
FIG. 1 is a 100× microphotograph of an Al—Nb alpha-2 titanium aluminide alloy/fiber compact following consolidation.

The alloys suitable for use in the present invention are the alpha+beta titanium alloys, also called "conventional" titanium alloys, the alpha-2 titanium alloys and the orthorhombic titanium alloys. The term "alpha+-beta" means an alloy of titanium which is characterized by the presence of significant amounts of alpha phase and some beta phase. Thus, the use of the so-called "alpha-beta" alloys, such as Ti-6Al-4V, as well as the so-called "beta" alloys, such as Ti-15V-3Cr-3Al-3Sn or Ti-10V-2Fe-3Al, constitute part of the invention. Other suitable alpha+beta alloys include, for example, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr, Ti-5.5Al-3.5Sn-3Zr-0.3Mo-1Nb-0.3Si, Ti-5.5Al-4Sn-4Zr-0.3Mo-1Nb-0.5Si-0.6C, Ti-30Mo, Ti-13V-11Cr-3Al, Ti-3Al-3V-6Cr-4Mo-4Zr, Ti-15V, Ti-11.5Mo-6Zr-4.5Sn, Ti-10Mo and Ti-6.3Cr.

Those skilled in the art recognize that there is a substantial difference between the two ordered titanium-aluminum intermetallic compounds, $Ti_3Al$ and TiAl. Alloying and transformational behavior of $Ti_3Al$ resemble those of titanium as they have very similar hexagonal crystal structures. However, the compound TiAl has a face-centered tetragonal arrangement of atoms and thus rather different alloying characteristics. Such a distinction is often not recognized in the earlier literature. Therefore, the discussion hereafter is largely restricted to that pertinent to the invention, which is within the $Ti_3Al$ alpha-2 phase realm. Suitable alpha-2 titanium alloys include Ti-16Al, Ti-14Al-25Nb and Ti-14Al-20Nb-3V-2Mo.

Additionally, there is a third class of ordered titanium-aluminum intermetallic compounds which comprise the orthorhombic (o) phase. These alloys are similar to the alpha-2 alloys, but contain greater quantities of beta stabilizer, preferably Nb, to stabilize the orthorhombic phase. Suitable orthorhombic alloys include Ti-13Al-31Nb and Ti-13Al-40Nb.

When the titanium alloy is a conventional alloy, the phrase "suitable consolidating conditions" is intended to mean heating the alloy-fiber preform to a temperature below the beta-transus temperature ($T_\beta$) of the alloy while applying a pressure of at least 10 Ksi for a time sufficient to effect consolidation. In this case, the term "beta-transus" refers to the temperature at the line on the phase diagram for the alloy separating the $\beta$-phase field from the $\alpha+\beta$ region where the $\alpha$ and $\beta$ phases coexist.

When the titanium alloy is an alpha-2 ($\alpha_2$) or an orthorhombic titanium aluminide alloy ($o$), the phrase "suitable consolidating conditions" is intended to mean heating the alloy-fiber preform to a temperature below the beta-transus temperature ($T_\beta$) of the alloy while applying a pressure of at least 10 Ksi for a time sufficient to effect consolidation. In the case of the alpha-2 alloy, the term "beta-transus" refers to the temperature at the line on the phase diagram for the alloy separating the $\beta$-phase field from the $\alpha_2+\beta$ region where the $\alpha_2$ and $\beta$ phases coexist. In the case of the orthorhombic alloy, the term "beta-transus" refers to the temperature at the line on the phase diagram for the alloy separating the $\beta$-phase field from the region where the $\beta$ and $o$ phases, and possibly the $\alpha_2$ phase, coexist.

In accordance with the first embodiment of the invention, thermal treatment of the prepared composite is accomplished by heating the composite to a temperature about 5 to 10% above $T_\beta$ (in degrees C.) for a time about 4 to 25% of the consolidation time. The thermal treatment is carried out immediately following the consolidation of the preform, prior to cooling the composite and prior to removing the composite from the consolidating apparatus. It is important that the time and temperature parameters be chosen such that any additional fiber-matrix interfacial reactions are minimized.

The matrix microstructure of the consolidated conventional alloy composite is a very fine equiaxed alpha structure, the result of the large amount of alpha+beta deformation during compaction, i.e., superplastic forming/diffusion bonding, as well as the compaction thermal cycle which is carried out in the alpha+beta phase field. Similarly, the matrix microstructures of the consolidated alpha-2 and the consolidated orthorhombic titanium aluminide composites are very fine equiaxed structures. Heat treatment of these very fine equiaxed structures produces a higher aspect ratio grain structure having increased fatigue crack propagation resistance without significantly increasing the thickness of the fiber/matrix reaction zone.

In accordance with the second embodiment of the invention the alloy-fiber preform is consolidated and thermal treatment is carried out by heating the alloy-fiber preform to a temperature about 5 to 10% above $T_\beta$ while applying a pressure of at least 10 Ksi for a time about 10 to 20% of the "normal consolidation time", i.e., the time required for consolidation at a temperature below $T_\beta$. It is important that the time and temperature parameters be chosen such that fiber-matrix interfacial reactions are avoided.

The titanium composites are fabricated by superplastic forming/diffusion bonding of a sandwich consisting of alternating layers of metal and fibers. At least four high strength/high stiffness filaments or fibers for reinforcing titanium alloys are commercially available: silicon carbide, silicon carbide-coated boron, boron carbide-coated boron and silicon-coated silicon carbide. Under superplastic conditions, the titanium matrix material can be made to flow without fracture occurring, thus providing intimate contact between layers of the matrix material and the fiber. The thus-contacting layers of matrix material bond together by a phenomenon known as diffusion bonding. Unfortunately at the same time a reaction occurs at the fiber-matrix interfaces, giving rise to what is called a reaction zone. The compounds formed in the reaction zone may include reaction products like TiSi, $Ti_5Si$, TiC, TiB and $TiB_2$. The thickness of the reaction zone increases with increasing time and with increasing temperature of bonding. Such reaction zones introduce sites for easy crack initiation and propagation within the composite which can operate in addition to existing sites introduced by the original distribution of defects in the filaments and/or the matrix.

The metal layers for fabricating the above-described sandwich are rolled sheet or foil having a thickness of 5 to 10 mils, or preferably rapidly solidified foil having a thickness of about 10 to 100 microns.

Consolidation of the filament/metal layer preform sandwich is accomplished by application of heat and pressure over a period of time during which the matrix material is superplastically formed around the filaments to completely embed the filaments. In accordance with the first aspect of the invention consolidation is carried out at a temperature in the approximate range of 50° to 300° C. (90° to 540° F.) below the beta-transus temperature of the titanium alloy. For example, the consolidation of a composite comprising Ti-6Al-4V alloy, which has a beta transus of about 995° C. (1825° F.) is preferably carried out at about 900° C. (1650° F.). The pressure required for consolidation of the composite ranges from about 66 to about 200 MPa (about 10 to 30 Ksi) and the time for consolidation can range from about 15 minutes to 24 hours or mores depending upon the thickness of the composite. Generally consolidation time is about 2 to 4 hours.

As discussed previously, the composite is heat treated at a temperature about 5 to 10% above $T_\beta$ for about 4 to 25% of the consolidation time. For example, a composite comprising Ti-6Al-4V alloy may be heat treated at a temperature of about 1045° to 1095° C. for about 5 to 60 minutes. This heat treatment will produce a higher aspect ratio grain structure having increased fatigue crack propagation resistance without significantly increasing the fiber/matrix reaction zone. Increased fatigue crack propagation resistance in the matrix provides in turns improvement in the overall fracture resistance of the composites particularly for off-axis loading applications.

In accordance with the second embodiment of the invention consolidation is carried out at a temperature in the approximate range of 10° to 40° C. (20° to 70° F.) above the beta-transus temperature of the titanium alloy. For example, the consolidation of a composite comprising Ti-6Al-4V alloy, which has a beta transus of about 995° C. (1825° F.) is preferably carried out at about 1025° C. (1875° F.). The pressure required for consolidation of the composite ranges from about 66 to about 200 NPa (about 10 to 30 Ksi) and the time for consolidation can range from about 30 minutes to 2 hours or more, depending upon the thickness of the composite. Generally, consolidation time is about 2 to 4 hours.

Figure 2:
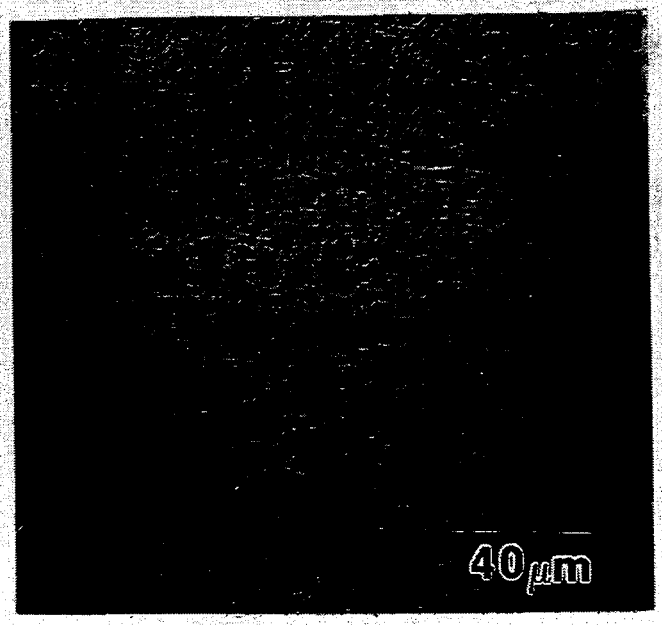
FIG. 2 is a 50× microphotograph of a similar compact following heat treatment at 1260° C. (beta-transus temperature+110° C.) for 10 minutes.

Referring to the drawing, in FIG. 1, it can be seen that the microstructure of the alloy, following consolidation is an equiaxed $\alpha_2+\beta+o$ microstructure. In FIG. 2, it can be seen that following heat treatment in accordance with the invention, the microstructure is a transformed, i.e., high aspect ratio $\alpha_2+\beta+o$ microstructure.

This microstructure has improved fracture and creep resistance.

Various modifications may be made to the invention as described without departing from the spirit of the invention or the scope of the appended claims.

We claim:

1. A method for increasing the fracture resistance of titanium alloy matrix composites which comprises the steps of (a) consolidating a titanium alloy-fiber preform under suitable conditions to provide a metal matrix composite and (b) thermally treating the thus-prepared composite by heating said composite to a temperature about 5 to 10% above the beta-transus temperature of the alloy, in degrees C, for about 4 to 25% of the consolidation time, wherein said thermal treatment step (b) is carried out immediately following said consolidation step (a).

2. The method of claim 1 wherein said titanium alloy is a conventional titanium alloy.

3. The method of claim 1 wherein said titanium alloy is an alpha-2 titanium aluminide alloy.

4. The method of claim 1 wherein said titanium alloy is an orthorhombic titanium aluminide alloy.

5. A method for increasing the fracture resistance of titanium alloy matrix composites which comprises consolidating an alloy-fiber preform at a temperature about 5 to 10% above the beta-transus temperature of the alloy for a time about 10 to 20% of the time required for consolidation at a temperature below said beta-transus temperature.

6. The method of claim 5 wherein said titanium alloy is a conventional titanium alloy.

7. The method of claim 5 wherein said titanium alloy is an alpha-2 titanium aluminide alloy.

8. The method of claim 5 wherein said titanium alloy is an orthorhombic titanium aluminide alloy.

* * * * *